US006126048A

United States Patent [19]

Bublitz

[11] Patent Number: 6,126,048

[45] Date of Patent: Oct. 3, 2000

[54] REMOVABLE PAINT CAN EXTENSION AND COVER

[76] Inventor: Todd F. Bublitz, 27000 De Berry Dr., Agoura Hills, Calif. 91301

[21] Appl. No.: 09/344,202

[22] Filed: Jun. 24, 1999

[51] Int. Cl.[7] ..... B65D 25/40; B65D 51/00; B65D 1/40; B67D 5/58; B67D 3/00

[52] U.S. Cl. ..... 222/570; 222/189.07; 222/481; 222/543; 220/287; 220/733

[58] Field of Search ..... 222/189.07, 481, 222/481.5, 547, 562, 570, 571, 543; 220/700, 701, 733, 744, 287

[56] References Cited

U.S. PATENT DOCUMENTS

| | | | |
|---|---|---|---|
| D. 254,482 | 3/1980 | Bell . | |
| 419,585 | 1/1890 | Crapo . | |
| 1,299,832 | 4/1919 | Holdsworth . | |
| 1,987,055 | 1/1935 | Dival | 222/570 |
| 1,994,335 | 3/1935 | Churan . | |
| 2,151,895 | 3/1939 | Carlson . | |
| 2,436,924 | 3/1948 | Hansen . | |
| 2,466,850 | 4/1949 | Hoffman et al. . | |
| 2,606,694 | 8/1952 | Galleta . | |
| 2,638,245 | 5/1953 | Loesel . | |
| 2,783,077 | 2/1957 | Pierce . | |
| 2,786,614 | 3/1957 | Giusto . | |
| 2,837,256 | 6/1958 | Daner . | |
| 3,366,272 | 1/1968 | Ballmann . | |
| 3,727,792 | 4/1973 | Levin . | |
| 3,894,650 | 7/1975 | Crump . | |
| 4,022,344 | 5/1977 | Roamer | 222/570 |
| 4,125,210 | 11/1978 | Embree . | |
| 4,225,064 | 9/1980 | Westcott . | |
| 4,240,568 | 12/1980 | Pool . | |
| 4,462,504 | 7/1984 | Roth et al. | 220/214 |
| 4,736,874 | 4/1988 | Durant | 222/570 |
| 4,893,723 | 1/1990 | Seabolt . | |
| 5,137,188 | 8/1992 | Thompson | 222/570 |
| 5,213,239 | 5/1993 | Macaluso | 222/570 |
| 5,549,227 | 8/1996 | Klotz | 222/570 |
| 5,720,408 | 2/1998 | Schmid | 222/570 |
| 5,941,427 | 8/1999 | Speer | 222/570 |

OTHER PUBLICATIONS

Package insert for Paint Pourer by "SHUR–Line Makes Painting Easy" No. 06100.

Package label for Super Lid by "Aqua–Tainer Co." Stk. No. SL96.

*Primary Examiner*—Kevin Shaver
*Assistant Examiner*—David A Bonderer
*Attorney, Agent, or Firm*—Kelly Bauersfeld Lowry & Kelly, LLP.

[57] ABSTRACT

A removable paint can extension and cover apparatus which can be temporarily attached to manufactured containers of paint products is provided. The apparatus includes, generally, a vertically extending skirt having a lip at an upper edge of a first end and a rim-covering flange towards a second end of the skirt, a lid insertable over the skirt to frictionally engage the lip of the skirt and having a top surface and a wall extending downwardly from the top surface, a spout removably connected to the top surface of the lid and having a filter removably positionable therein, and a fastener for attaching the skirt to the paint container. The top surface of the lid includes a spout-accepting aperture having a flange to which the spout is connected, and an air inlet aperture and a tether aperture to which a detachable spout cap having a tether is attachable. The fastener includes a resilient annulus disposed on the skirt beneath the flange of the skirt, the annulus frictionally engaging the rim of the paint container in order to secure the skirt to the paint container.

20 Claims, 4 Drawing Sheets

REMOVABLE PAINT CAN EXTENSION AND COVER

BACKGROUND OF THE INVENTION

The present invention relates to an attachable paint can lid replacement. More particularly, the present invention relates to a removable paint can extension member and attachable cover having a filter, cover lid, and pour spout.

For quite some time painters have sought ways to eliminate messiness and other problems associated with painting. One of the longstanding problems associated with painting is that once a container filled with liquid paint is opened it is practically impossible to stir its contents or add other product enhancements, such as pigments or thinners, without causing the paint to flow over the sides of the container. The common acts of wiping excess paint from a brush against the container rim or pouring paint directly from the original container also causes such undesirable overflow. Paint overflow onto the sides of the container often renders the product label unreadable, preventing the user from reading the instructions and correctly identifying the qualities of the paint. Information that may be rendered unreadable includes product name, color identification, application requirements, drying and recoat times, the correct solvents to use for thinning or cleaning, and disposal information and warnings.

Many paint containers have a grooved rim which facilitates the airtight closure and removal of the container's lid. However, paint overflow sometimes fills this groove, requiring the inconvenient cleaning of the rim after painting. If the rim is not thoroughly cleaned after use, it becomes practically impossible to reseal the container in an airtight fashion with its original lid as the lid sits on a layer of paint instead of properly fitting within the groove. The inability to properly reseal the original container causes the deterioration or evaporation of the liquid paint product over time, resulting in the discarding of partially emptied paint containers.

Paint containers, particularly previously opened containers, often contain impurities from a variety of sources including improper mixing, foreign objects, dried paint product that has accumulated on the rim and fallen back into the container, or paint product that has hardened by "skimming over" because the container was previously sealed in a non-airtight manner. Painters often wish to pour clean filtered paint product into secondary containers such as roller trays or the holding tanks of pressure spraying equipment for non-brushing applications. No neat and practical way exists for the filtering of impurities from liquid paint products in situations where the user wishes to filter out such impurities while pouring the paint product directly from its original container into secondary receiving containers. Nor does any such convenient method for reclaiming the usable portion of contaminated paint from previously opened containers exist.

Currently, the user must pour the paint from the original container through either a rigid cone-shaped or a flexible fabric filter. The cone-shaped filters must be strategically placed and are prone to tip or fall away resulting not only in wasted paint, but also raising a concern of the purity of the paint in the receiving container. Fabric filters can be stretched so as to fit over their receiving containers, but they must then be manually lifted from the receiving containers in order to function. Since a fabric filter must be handheld over the receiving container for the duration of the filtration process, the tendency is for the painter to speed up the filtration process by squeezing the filter which is a very messy undertaking. Further, both of the above mentioned filtration methods requires the messy disposal of the filtration devices after use.

Moreover, painters often apply paint by dipping a brush and then swiping excess paint from said brush against the rim of the original paint container. During this period of use, paint accumulating in or around the rim of the container can dry or become tacky. The dried or tacky particles of paint then diminish the quality of the painting application when transferred to the painted surface by the bristles of the brush. No device currently provides for the collection and easy disbursement of this unwanted accumulation of dried or tacky paint.

Further, painters may want to pour the unused portions of paint remaining in secondary containers back into their original containers after use, or they may want to divide or save portions of paint from larger containers to be stored in smaller standardly sized containers for convenience. Again, no device for the purpose of neatly channeling unused portions of paint back into standardly sized containers currently exists.

Therefore, what is needed is a device which increases the effective capacity of the original container so that a painter may add and stir additives and which simply installs onto a paint container and which prevents paint product from overflowing and seeping into the rim and over the sides of the paint container. Also, what is needed is a device which is able to neatly and conveniently pour and filter liquid paint products, reclaim the usable portions of contaminated paint from previously opened containers, and which also includes a leakproof cover for temporary storage. Further, what is needed is a device that serves as a temporary collector of the unwanted accumulation of dried or tacky paint where such device can be easily and conveniently removed as often as necessary to be cleaned and thereby enhance the quality of painting applications. Lastly, a device for allowing unused portions of paint from secondary containers to be neatly channeled back into their original, or other standardly sized containers, is also needed. The present invention fulfills these needs and provides other related advantages.

SUMMARY OF THE INVENTION

The present invention resides in a removable paint can extension and cover apparatus which can be temporarily attached to manufactured containers of paint products. The apparatus increases the capacity of the original containers to allow for additives and mixing operations without overflow, as well as provides a means for pouring and filtering liquid paint products directly from their original containers and for reclaiming the usable portions of contaminated paint products from previously opened containers which have been sealed poorly. The apparatus also serves as a temporary appendage to collect the unwanted accumulation of dried or tacky paint in order to enhance the quality of painting applications. Further, the apparatus provides for the airtight resealing of the original container using either the apparatus or the original lid in a paint-free preserved rim, and allows for paint from secondary containers to be repoured back into the original container in a neat an convenient manner.

The apparatus comprises, generally, a vertically extending skirt having a lip at an upper edge of a first end and a rim covering flange towards a second end of the skirt, a lid insertable over the skirt to frictionally engage the lip of the skirt and having a top surface and a wall extending downwardly from the top surface, a spout removably connected to the top surface of the lid, and a fastener for securing the skirt to the paint container. The lid includes an inner surface having a channel which accepts the lip of the skirt so as to frictionally engage the skirt. The top surface of the lid also includes a spout-accepting aperture having a flange to which the spout is connected and into which a filter may be inserted and held, preferably by threading the spout to the lid. An air inlet aperture and tether aperture also reside in the top surface of the lid. A tether connecting a cap for the pour spout aperture to a cap for the air inlet aperture is connected to the lid by insertion of its tab into its own aperture whereby the tether allows each cap to remain attached to the lid even while either or both caps may be removed from their respective apertures.

In the preferred embodiment, alignment indicators are provided on the two opposing sides of each the lid and the skirt to enable the user to attach the apparatus in such a way as to maximize all of its functions. The skirt contains a notch to allow for smooth paint flow when aligned with the pour spout of the lid and the skirt is designed to allow the handle of the paint container to which it is attached to pass completely over it. The fastener of this embodiment includes a formed or attached resilient annulus disposed towards the tapered lower end of the skirt beneath the flange whereby such annulus frictionally engages the rim of the paint container in order to secure the skirt to the paint container.

The top surface of the lid has an indented portion to provide space between the top surface of the lid and the underside of a vertically positioned paint can handle thereby allowing the fully assembled apparatus to be transported or hung by the handle when aligned in the proper position. The wall of the lid typically includes an embrasure therein which provides a point for removal of the lid from the skirt, usually by insertion of a finger. A tab protruding from the flange of the skirt can be positioned directly under the embrasure of the cover lid whereby it may be grasped with the fingers of one hand to stabilize the skirt during removal of the lid. Additionally, the tab of the flange contains an aperture whereby the entire assembled apparatus may be hung for display or storage.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
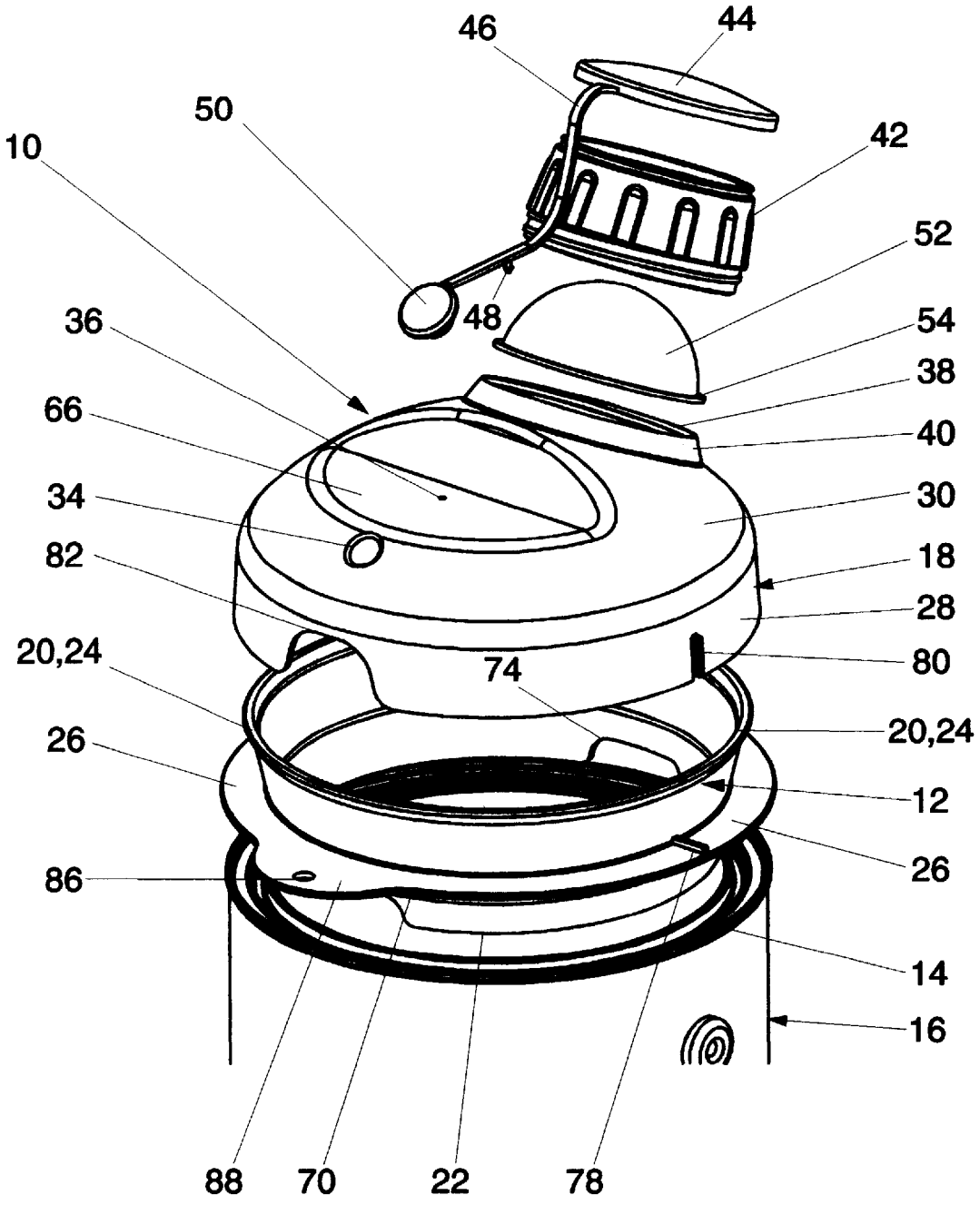
FIG. 1 is an exploded perspective view of a paint container extension and cover apparatus embodying the present invention.
Figure 2:
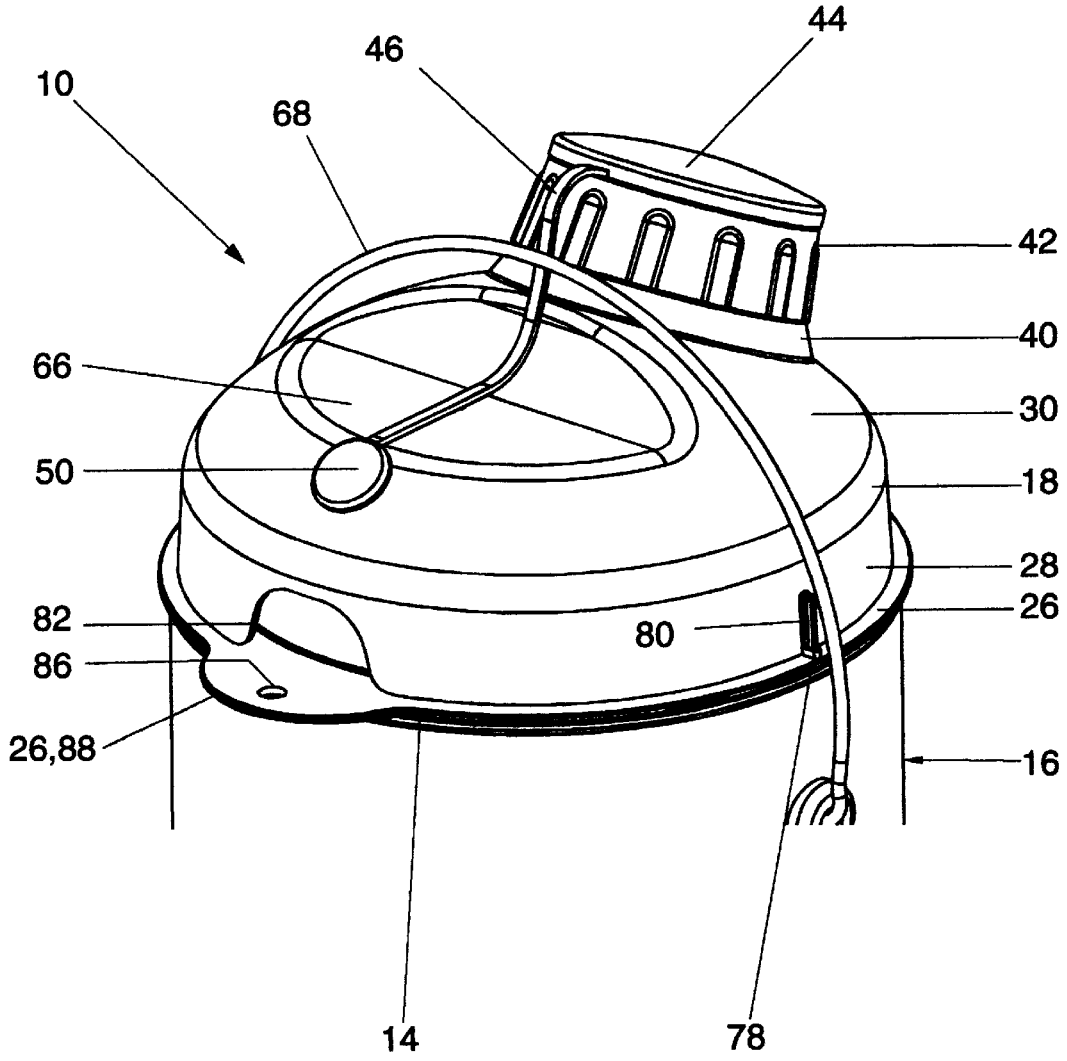
FIG. 2 is an assembled perspective view of the apparatus of FIG. 1 illustrating a paint can handle raised over the apparatus.

As shown in the drawings for purposes of illustration, the present invention is concerned with a paint container extension and cover apparatus generally illustrated in FIGS. 1–4 and referred to by the reference number 10. The apparatus 10 is generally comprised of a skirt 12 which is engaged to the rim 14 of a paint container 16 and a lid 18 which is insertable over the skirt 12 to frictionally engage the skirt 12. The apparatus 10 is particularly designed to be used on gallon-sized paint containers 16 with grooved rims 18 which protrude into the container 16, although the apparatus 10 may be modified as necessary to accommodate other paint container sizes. The skirt 12 and lid 18 are composed of durable non-porous material, such as hardened plastic, which is resistant to turpentine and other paint thinners, cleaning solvents and chemicals. The skirt 12 and lid 18 are formed so as to have smooth, soft angles which promotes the flow of paint back into the container 16 and further facilitates the cleaning of residual paint from the apparatus 10.

The skirt 12 has first and second ends 20 and 22 which extend downwardly from the first end 20 at an angle which slopes into the container 16. A lip 24 forms an upper edge of the first end 20. Towards the second end 22, a flange 26 extends from the circumference of the skirt 12. The flange 26 is configured so as to cover the top surface of the rim 14 of the container 16.

Figure 3:
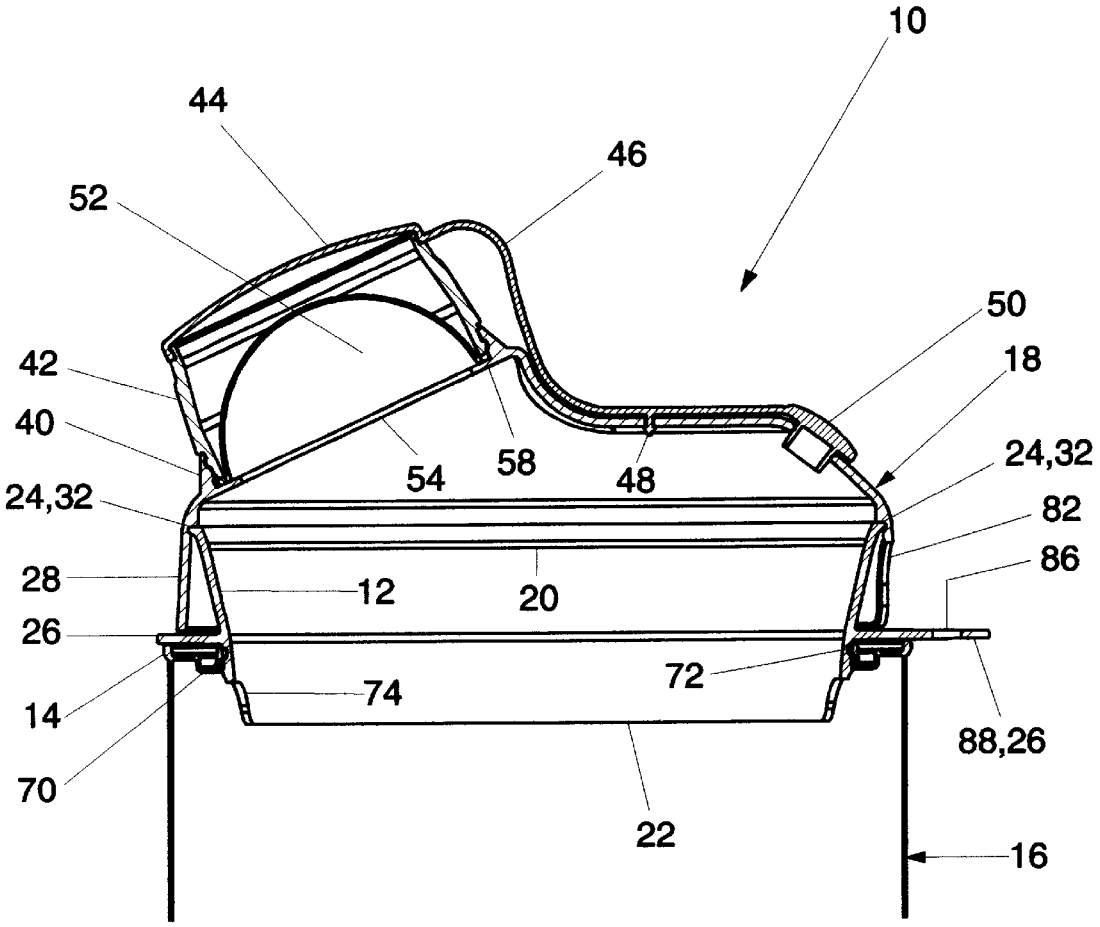
FIG. 3 is a cross-sectional view of the apparatus of FIG. 2.
Figure 4:
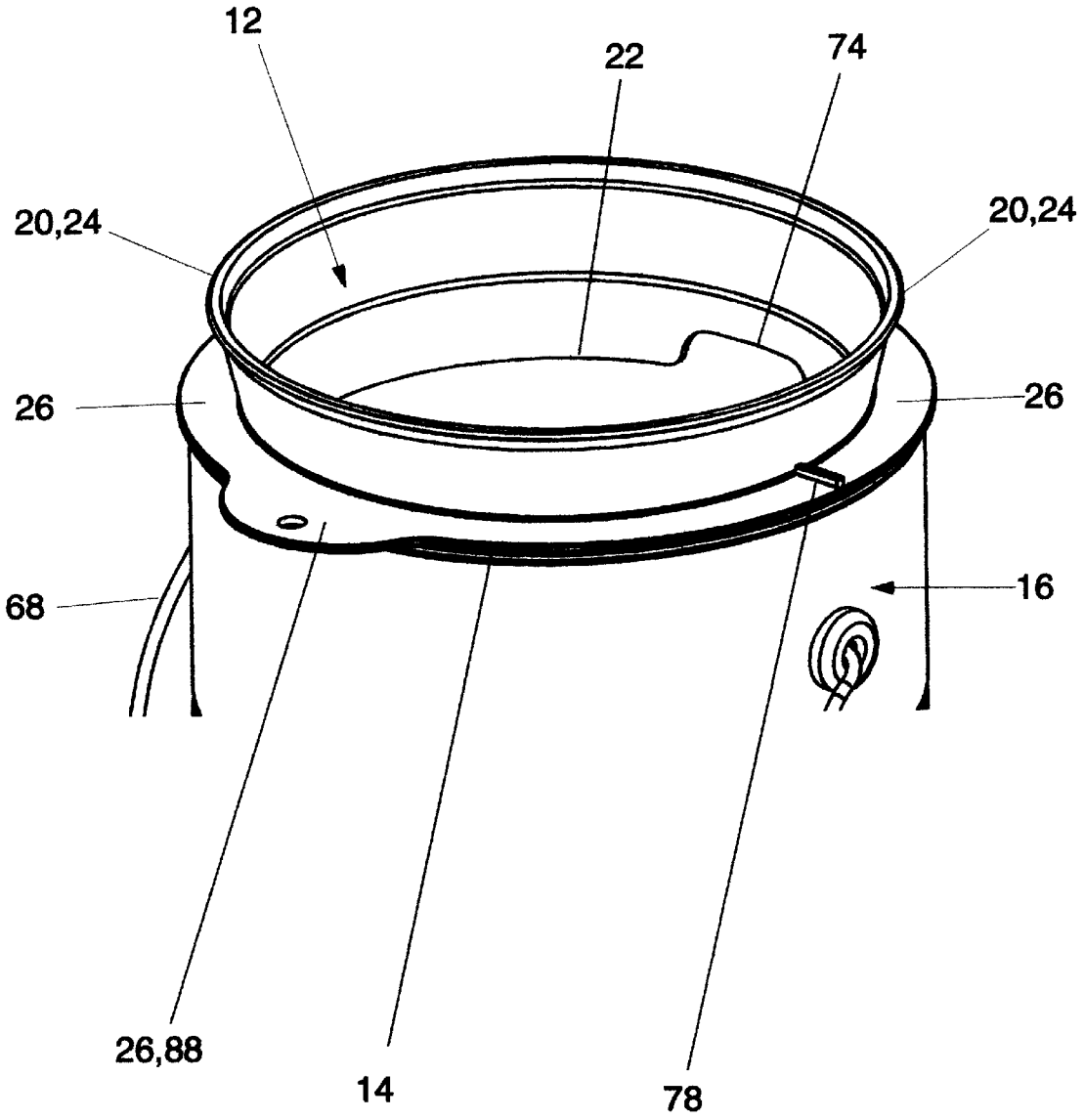
FIG. 4 is a perspective view of the skirt portion of the apparatus of the present invention secured to a paint container.

As illustrated in FIGS. 1 and 3, an annulus 70 formed of resilient materials, such as rubber or plastic, is formed or attached to the lower tapered end of the skirt 12 beneath the flange 26 so as to frictionally engage the inner edge 72 of the rim 14. This is usually accomplished by pushing and/or twisting the skirt 12 into the paint container 16 until the annulus 70 engages the rim 14. The tapered lower end of the skirt 12 compensates for the variation in diameters of the rims 14 of standardly manufacture paint containers 16. The fastener of the skirt to the container may alternatively comprise a series of descending annuli formed or attached to the lower tapered perimeter of the skirt below the flange whereby such sequentially changing diameters of each annulus, when differentiated from topmost to bottommost, account and compensate for the slight variations in the diameter of the rims of standardly manufactured paint containers, and whereby the rough surface resultant from the close association of said annuli causes the skirt to frictionally engage to the rim of said containers. The materials used to form this attachment method are not limited to rubber or plastic but may be any suitable material which causes the desired frictional engagement. In yet another form, the fastener of the skirt to the container may comprise a layer of any suitable flexible rubberlike material connected to or attached over the tapered lower end of the skirt below the flange whereby such flexible material causes the skirt to be frictionally engaged to the rim of the container.

To maximize the flow of paint from a container 16 having a skirt 12 or the apparatus 10 thereon, an enlarged notch 74 is formed within the skirt 12 to direct the flow of paint. The skirt may be secured to the container 16 without the lid 18 in order to allow the painter to freely mix and access the paint within the container 16. As the skirt 12 is generally sloped, the painter may swipe excess paint from the brush onto the lip 24 of the first end 20 of the skirt with the excess paint naturally flowing back into the paint container 16. The skirt 12 may be conveniently detached from the rim 14 of the container 16 as often as necessary in order to facilitate the removal of any accumulated dried paint. A further advantage is that paint may be poured directly from the container 16 when only the skirt 12 is attached, although a certain degree of precision may be lost without the spout 42 to more accurately guide the paint.

If the painter wants to pour, filter, or temporarily store the paint, the lid 18 is placed over and engaged to the skirt 12.

The lid 18 includes a wall 28 extending downwardly from a top surface 30. A channel 32 is formed on an inner surface of the lid 18, typically near or at the junction of the wall 28 and the top surface 30. The width of the channel 32 is such that the lip 24 of the skirt 12 frictionally fits within the space of the channel 32 when the lid 18 is pushed onto the skirt 12, and is preferably formed so as to create an airtight and leakproof seal. The wall 28 of the lid 18 contacts the flange 26 of the skirt 12 to indicate to the user that the lid 18 is fully engaged to the skirt 12.

The top surface 30 has an air inlet aperture 34, a tether aperture 36, and a spout-accepting aperture 38. The spout-accepting aperture 38 includes a raised flange 40 into which an open-ended pour spout 42 is removably connected. The spout 42 may be pushed into frictional contact with the flange 40, but more preferably the spout is threadedly connected to the flange 40. The spout can be covered and sealed with a spout cap 44. The spout cap 44 includes a tether 46 having a tether insertion tab 48 insertable into the tether aperture 36 and an air inlet plug 50 which seals off the air inlet aperture 34 from the outside environment. The insertion tab 48 usually remains within the tether aperture 36 in order to hold the tether 46, cap 44, and cap 50 to the lid 18 when cap 50 is removed from the air inlet aperture 34 and the cap 44 is removed from the spout 42 when pouring paint. The opened air inlet aperture 34 promotes a more constant flow of paint by preventing a vacuum effect from occurring by equalizing pressures within and without the apparatus 10 when pouring paint.

To simultaneously pour and filter paint, a filter 52 is positionable within the spout 42 as illustrated in FIG. 3, with a bottom edge 54 of the filter 52 typically resting on a shelf 58 within the spout-accepting flange 40. The filter 52 is held securely in place when the threaded or frictionally engaged open end of the spout 42 pinches the bottom edge 54 of the filter 52 against the shelf 58 within the flange 40. The filter 52 may be conveniently inserted or removed without the necessity of removing the lid 18. The filter 52 may be of varying gradations to accommodate the different filtering requirements of the painter. Furthermore, the filter 52 may be reusable and capable of being cleaned with paint thinner, terpentine, etc. or may be disposable after the painting session. The filter 52 is purposefully shaped to maximize the area of filtering surface. When paint needs to be poured but not filtered, the filter 52 can be removed from the spout 42. The ability to remove the spout 42 and the filter 52 without removing the lid 18 also provides a way to allow the handle 68 of the paint container 16 to swing over the lid 18 if it is accidentally disposed on the wrong side of the spout 42 during initial engagement of the apparatus 10 to the container 16.

The top surface 30 of the lid 18 may include a recess or indented portion 66 so that a space is created between the top surface 30 of the lid 18 and the underside of a vertically positioned handle 68 of a paint container 16 so that the entire apparatus 10 may be transported or hung by the handle 68. As best viewed in FIGS. 1 and 2, an embrasure 82 may be formed in the wall 28 of the lid 18 so that the painter can insert his or her fingers into the embrasure 82 to pry the lid 18 off of the skirt 12. To aid in the removal of the lid 18 from the skirt 12, a portion of the flange 26 of the skirt 12 projects to form a tab 88 so that the tab 88 may be held with fingers of one hand to stabilize the skirt 12 while the lid 18 is pried off at the embrasure 82 of the lid 18 with fingers of the other hand. The tab 88 of the flange 26 may additionally contain an aperture 86 through which to hang the completely assembled apparatus 10 for display or storage.

In order that the skirt 12 is inserted into the rim 14 of the container 16 in the preferred direction, alignment indicators 78 are provided on the top surface of each of the two opposite sides of the flange 26. When the alignment indicators 78 align with the termination points of the handle 68 of the container 16, the skirt 12 is correctly positioned to allow the paint can handle 68 to fully pass over the skirt 12. The container 16 can then be transported, held, or hung by the paint can handle 68 while the skirt 12 is engaged to the rim 14 of the container 16. Additional alignment indicators 80 are positioned on each of the two opposite sides of the exterior wall 28 of the lid 18. Assuming that the skirt 12 is properly positioned as just mentioned, matching the alignment indicators 80 of the wall 28 with the alignment indicators 78 of the flange 26 when engaging the lid 18 to the skirt 12, and additionally generally placing the embrasure 82 of the lid 18 over the tab 88 of the flange 26, the apparatus 10 will be positioned such that the notch 74 of the skirt 12 will work in conjunction with the pour spout 42 of the lid 18 to maximize proper paint flow and will additionally allow the paint can handle 68 of the container 16 to pass to the vertical position over the recess 36 of the lid 18.

It is important to note that alignment indicators 78 and 80 are provided merely as an aid in achieving the ultimate performance from the apparatus 10 by providing a means for maximizing the flow of paint through the alignment of the notch 74 of the skirt 12 to the spout 42 of the lid 18, and additionally by allowing the user to consider the relation of the components of the apparatus 10 to the handle 68 of the container 16. However, the improper alignment of the skirt 12 to the container 16, or the improper alignment of the lid 18 to the skirt 12, only causes slight diminishment of maximized paint flow and the inconvenience of having the handle 68 of the paint container 16 to be inconveniently disposed. Such improper alignment does not adversely affect any of the main intended functions of the apparatus 10, i.e. those functions related to rim protection, overflow prevention, container capacity extension, collection for disbursement of unwanted accumulations, filtration processes, overall pouring function, or use as a temporary coverage device.

Using the paint can extension and cover apparatus 10 of the present invention is advantageous as the design of the apparatus 10 prevents paint from overflowing into the grooved rim 14 and extends the effective height of the container 16 which allows a painter to mix pigments, thinners, and other additives without the paint product overflowing the paint container 16. The skirt 12 has a maximized opening so that the painter is not impeded in the insertion of objects within the opening of the container 10. The container 10 may be effectively sealed using the container's original lid as the rim 14 is protected by the flange 26 and the skirt 12, keeping the rim 14 thoroughly clean of paint and protecting the rim 14 from dents and other deformations. Alternatively, the lid 18 may be attached to the skirt 12 and the apparatus 10 fastened to the container 16 for temporary storage as the apparatus forms an airtight and seal over the container 16. All components of the apparatus 10 are easily engaged to each other and to the paint container 16 without the need for tools and are removable from one container to another.

Although the above embodiment has been described in detail for purposes of illustration, various modifications may be made without departing from the scope and spirit of the invention. Accordingly, the invention is not limited, except as by the appended claims.

What is claimed is:

1. An apparatus removably attachable to a rim of a paint container, comprising:

a vertically extending skirt having first and second open ends and a rim-covering flange towards the second end of the skirt;

a lid including a top surface and a wall extending downwardly from the top surface, the lid being insertable over the first end of the skirt to frictionally engage the skirt;

a spout removably connected to the top surface of the lid; and a fastener for attaching the skirt to the paint container.

2. The apparatus of claim 1, wherein the first end of the skirt includes a lip.

3. The apparatus of claim 2, wherein an inner surface of the lid includes a channel which accepts the lip of the skirt.

4. The apparatus of claim 1, wherein the top surface of the lid includes an air inlet aperture, a spout-accepting aperture, and a tether aperture.

5. The apparatus of claim 4, wherein the spout-accepting aperture includes a flange to which the removable spout is connected.

6. The apparatus of claim 4, including a detachable spout cap having a tether attachable to the air inlet aperture and the tether aperture of the top surface.

7. The apparatus of claim 1, wherein the top surface of the lid includes an indented portion.

8. The apparatus of claim 1, wherein the wall of the lid is configured to form an embrasure therein.

9. The apparatus of claim 1, wherein an inner surface of the skirt is configured to form an enlarged notch within the skirt.

10. The apparatus of claim 1, wherein the fastener includes a resilient annulus disposed on the skirt beneath the flange which frictionally engages the rim of the paint container in order to secure the skirt to the paint container.

11. The apparatus of claim 1, including alignment indicators formed on opposing sides of the skirt and lid.

12. The apparatus of claim 1, including a filter removably positionable within the spout.

13. An apparatus removably attachable to a rim of a paint container, comprising:

a vertically extending skirt having first and second open ends and a lip at an upper edge of the first end and a rim-covering flange towards the second end of the skirt;

a lid having an inner surface, a top surface and a wall extending downwardly from the top surface, the top surface including an indented portion and a spout-accepting aperture having a flange, the inner surface having a channel which accepts the lip so as to frictionally engage the skirt;

a spout removably connected to the flange of the spout-accepting aperture;

a detachable spout cap; and a fastener including a resilient annulus disposed on the skirt beneath the flange which frictionally engages the rim of the paint container for securing the skirt to the paint container.

14. The apparatus of claim 13, wherein the top surface of the lid includes an air inlet aperture and a tether aperture.

15. The apparatus of claim 14, wherein the spout cap includes a tether attachable to the air inlet aperture and the tether aperture of the top surface.

16. The apparatus of claim 13, including a filter removably positionable within the spout.

17. The apparatus of claim 13, wherein the wall of the lid is configured to form an embrasure therein.

18. The apparatus of claim 13, wherein an inner surface of the skirt is configured to form a enlarged notch within the skirt.

19. The apparatus of claim 13, including alignment indicators formed on opposing sides of the lid and skirt.

20. An apparatus removably attachable to a rim of a paint container, comprising:

a vertically extending skirt having first and second open ends and a lip at an upper edge of the first end and a rim-covering flange towards the second end of the skirt;

a lid having an inner surface, a top surface and a wall extending downwardly from the top surface and configured to form an embrasure therein, the top surface including an indented portion, a spout-accepting aperture having a flange, an air inlet aperture and a tether aperture, the inner surface having a channel which accepts the lip so as to frictionally engage the skirt;

alignment indicators formed on opposing sides of the lid and skirt;

a spout removably connected to the flange of the spout-accepting aperture;

a filter removably positionable within the spout;

a detachable spout cap having a tether attachable to the air inlet aperture and the tether aperture; and a fastener including a resilient annulus disposed on the skirt beneath the flange which frictionally engages the rim of the paint container for securing the skirt to the paint container.

* * * * *